US008579418B2

(12) United States Patent
Enomoto et al.

(10) Patent No.: US 8,579,418 B2
(45) Date of Patent: Nov. 12, 2013

(54) LIQUID EJECTION HEAD AND IMAGE FORMING APPARATUS INCLUDING LIQUID EJECTION HEAD

(75) Inventors: Katsumi Enomoto, Kanagawa-ken (JP); Yasuhiko Maeda, Kanagawa-ken (JP)

(73) Assignee: FUJIFILM Corporation, Tokyo (JP)

( * ) Notice: Subject to any disclaimer, the term of this patent is extended or adjusted under 35 U.S.C. 154(b) by 172 days.

(21) Appl. No.: 13/193,174

(22) Filed: Jul. 28, 2011

(65) Prior Publication Data

US 2011/0277319 A1 Nov. 17, 2011

Related U.S. Application Data

(62) Division of application No. 11/711,041, filed on Feb. 27, 2007, now abandoned.

(30) Foreign Application Priority Data

Feb. 28, 2006 (JP) ..... 2006-053947

(51) Int. Cl.
*B41J 2/045* (2006.01)

(52) U.S. Cl.
USPC ..... 347/71; 347/50; 347/58; 347/68; 347/70; 29/25.35; 29/890.1; 29/830; 29/831; 29/852

(58) Field of Classification Search
None
See application file for complete search history.

(56) References Cited

U.S. PATENT DOCUMENTS

| | | | | |
|---|---|---|---|---|
| 3,346,689 | A * | 10/1967 | Parstorfer | 174/265 |
| 6,431,683 | B1 | 8/2002 | Ho et al. | |
| 6,631,981 | B2 | 10/2003 | Isono et al. | |
| 7,469,993 | B2 * | 12/2008 | Murata et al. | 347/50 |
| 2006/0066689 | A1 * | 3/2006 | Hori | 347/68 |
| 2006/0209139 | A1 | 9/2006 | Murata | |

FOREIGN PATENT DOCUMENTS

| | | | |
|---|---|---|---|
| JP | 11-126968 | A | 5/1999 |
| JP | 2002-321352 | A | 11/2002 |
| JP | 2003-182076 | A | 7/2003 |
| JP | 2005-254616 | A | 9/2005 |
| JP | 2005-259845 | A | 9/2005 |

* cited by examiner

*Primary Examiner* — Uyen Chau N Le
*Assistant Examiner* — Chad Smith
(74) *Attorney, Agent, or Firm* — Birch, Stewart, Kolasch & Birch, LLP

(57) ABSTRACT

The liquid ejection head for ejecting liquid from nozzles includes: pressure chambers connecting to the nozzles; a common liquid chamber which is connected to the pressure chambers, is arranged across the pressure chambers from the nozzles, and is defined by at least a multi-layer wiring substrate which has a recess-shaped structure including a base section forming one of a ceiling and a floor of the common liquid chamber and a projecting section forming a side wall of the common liquid chamber; electrical wires which are formed at least partially inside the multi-layer wiring substrate; and a connection electrode which is provided in a top of the projecting section of the multi-layer wiring substrate.

2 Claims, 13 Drawing Sheets

LIQUID EJECTION HEAD AND IMAGE FORMING APPARATUS INCLUDING LIQUID EJECTION HEAD

This application is a Divisional of application Ser. No. 11/711,041 filed on Feb. 27, 2007 now abandoned, which claims priority to Application No. 2006-053947 filed in Japan, on Feb. 28, 2006. The entire contents of all of the above applications is hereby incorporated by reference.

BACKGROUND OF THE INVENTION

1. Field of the Invention

The present invention relates to a liquid ejection head and an image forming apparatus including a liquid ejection head, and more particularly, to a structure and electrical wiring for a liquid ejection head, and to a method of manufacturing a liquid ejection head.

2. Description of the Related Art

As an image forming apparatus in the related art, an inkjet printer (inkjet recording apparatus) is known, which includes an inlet printer head (liquid ejection head, which is also referred to as, simply, "head") having an arrangement of a plurality of liquid ejection nozzles and which records an image on a recording medium by ejecting ink (liquid) from the nozzles toward the recording medium while causing the relative movement between the inkjet head and the recording medium.

An inkjet head of an inkjet printer of this kind has pressure generating units. Each pressure generating unit includes, for example, a pressure chamber to which ink is supplied from an ink tank via an ink supply channel, a piezoelectric element which is driven by an electrical signal in accordance with image data, a diaphragm which constitutes a portion of the pressure chamber and deforms in accordance with the driving of the piezoelectric element, and a nozzle which is connected to the pressure chamber. The ink inside the pressure chamber is ejected from the nozzle in the form of a droplet due to the volume of the pressure chamber being reduced by the deformation of the diaphragm. In an inkjet printer, an image is formed on the recording medium by combining dots formed by ink ejected from the nozzles of the pressure generating units.

Ink ejection is controlled by transmitting electrical signals to the piezoelectric elements that are to be driven. Various methods have been proposed with respect to how to arrange the electrical wires for transmitting the electrical signals and how to arrange the substrate having drive ICs (integral circuits), from viewpoints of component counts, manufacturing costs, and compactification of the apparatus.

For example, Japanese Patent Application Publication No. 2003-182076 discloses that ICs (integral circuits) serving as drive circuits are fixed on a bonding substrate which covers the piezoelectric elements, and the ICs are connected with electrodes and connected with each other, by wire bonding. Thereby, the installation surface area can be reduced and a head can be made more compact.

Moreover, Japanese Patent Application Publication No. 2005-254616 discloses that a portion of walls of a common liquid chamber is constituted by a flexible substrate, or the like, thereby reducing the overall size of the head of an inkjet printer.

However, in the invention described in Japanese Patent Application Publication No. 2003-182076 mentioned above, since a connection between ICs and a connection between an IC and an electrode are made by wire bonding, then, in a device such as a printer including a drive unit, there is a possibility of disconnection due to vibrations or impacts, and accordingly reliability is poor. Moreover, since the electrodes to which ICs are connected by wire bonding are provided at the bottom face of a recess shape, then problems arise as to workability and work efficiency in wire bonding. Furthermore, since a common liquid chamber is provided beside a pressure chamber row, then it is necessary to arrange nozzles and a common liquid chamber alternately in order to achieve a matrix configuration of nozzles. There is a possibility that the head increases in size.

In the invention described in Japanese Patent Application Publication No. 2005-254616, similarly to the invention of Japanese Patent Application Publication No. 2003-182076, the electrodes to be connected by wire bonding are provided at the bottom surface of a recess shape, and therefore, reliability is poor and problems of work efficiency may arise. Moreover, a flexible substrate with high-density wirings which is used for the electrical wiring substrate is extracted outside. Hence, the installation space of the head is increased.

SUMMARY OF THE INVENTION

The present invention has been contrived in view of these circumstances, an object thereof being to provide a liquid ejection head and a method of manufacturing a liquid ejection head, and to provide an image forming apparatus including this liquid ejection head, whereby the liquid ejection head can be made compact in size, the high density arrangement can be attained, the number of components can be reduced, the reliability of the electrical connections is improved, and high-density wiring can be achieved.

In order to attain the aforementioned object, the present invention is directed to a liquid ejection head for ejecting liquid from nozzles, the liquid ejection head comprising: pressure chambers connecting to the nozzles; a common liquid chamber which is connected to the pressure chambers, is arranged across the pressure chambers from the nozzles, and is defined by at least a multi-layer wiring substrate which has a recess-shaped structure including a base section forming one of a ceiling and a floor of the common liquid chamber and a projecting section forming a side wall of the common liquid chamber; electrical wires which are formed at least partially inside the multi-layer wiring substrate; and a connection electrode which is provided in a top of the projecting section of the multi-layer wiring substrate.

In this aspect of the present invention, the common liquid chamber is defined by the multi-layer wiring substrate. Since the electrical wires are formed in multi-layered fashion, then it is possible to form wires at higher density without increasing the size of the head, and moreover a head having high airtightness and high reliability can be composed.

Preferably, the electrical wires are all formed inside the multi-layer wiring substrate.

In this aspect of the present invention, since the electrical wires are formed internally, then shorting or connection failures can be avoided, and therefore high reliability can be achieved.

Preferably, a plurality of electrical connection holes having different volumes are provided in the multi-layer wiring substrate.

In this aspect of the present invention, the connection sections of the wires formed in different layers can be exposed. Therefore, it is possible to achieve reliable connections at high density.

Preferably, the multi-layer wiring substrate is a ceramic multi-layer wiring substrate.

By using a ceramic multi-layer wiring substrate having high rigidity and high airtightness, it is possible to maintain the stability of the head, and moreover, improvements in shape stability and airtightness can be achieved.

In order to attain the aforementioned object, the present invention is also directed to a method of manufacturing a liquid ejection head comprising a multi-layer wiring substrate which is provided with first electrical wires and has a recess-shaped structure, a flat substrate provided with an electrical circuit, and a liquid ejection substrate which is provided with second electrical wires and piezoelectric elements, the method including the steps of: mechanically bonding the multi-layer wiring substrate to the liquid ejection substrate; electrically connecting the first electrical wires provided with the multi-layer wiring substrate, to the second electrical wires provided with the liquid ejection substrate; mechanically bonding the multi-layer wiring substrate to the flat substrate; and electrically connecting the first electrical wires provided with the multi-layer wiring substrate, to the electrical circuit provided with the flat substrate.

A plurality of electrical connections can be made together, and good mass-productivity can be achieved. Therefore, it is possible to manufacture a highly reliable liquid ejection head having high-density wiring, readily and inexpensively.

In order to attain the aforementioned object, the present invention is also directed to a method of manufacturing a liquid ejection head comprising a multi-layer wiring substrate which has a recess-shaped structure and is provided with first electrical wires and first holes, and a liquid ejection substrate which includes piezoelectric elements and is provided with second electrical wires and second holes, the method including the steps of: mechanically bonding the multi-layer wiring substrate to the liquid ejection substrate so that the first holes of the multi-layer wiring substrate are superimposed onto the second holes of the liquid ejection substrate so as to form electrical connection holes constituted by the first holes and the second holes; and filling a conductive paste into the electrical connection holes so that the first electrical wires and the second electrical wires are electrically connected via the conductive paste, wherein the electrical connection holes do not have a uniform volume.

Even if the volume of the electrical connection holes is not uniform, the electrical connections can be made together and reliably, and moreover, a liquid ejection head of compact size having highly reliable connections can be manufactured readily.

Preferably, the first electrical wires provided with the multi-layer wiring substrate and the second electrical wires provided with the liquid ejection substrate are electrically connected through the steps of: filling a conductive paste into electrical connection holes that are formed by mechanically bonding the multi-layer wiring substrate to the liquid ejection substrate; putting the multi-layer wiring substrate and the liquid ejection substrate which are mechanically bonded, into a vacuum chamber; reducing pressure inside the vacuum chamber; and returning the pressure inside the vacuum chamber to atmospheric pressure, after reducing pressure inside the vacuum chamber.

In this aspect of the present invention, it is possible to manufacture a liquid ejection head of compact size having highly reliable connections, at a good production yield.

In order to attain the aforementioned object, the present invention is also directed to a method of manufacturing a liquid ejection head comprising a common liquid chamber defined by at least a multi-layer wiring substrate which has a recess-shaped structure and is provided with first electrical wires, and a flat substrate being provided with second electrical wires, the method including the steps of: forming an intermediate layer of at least one of an anisotropic conductive film, an anisotropic conductive paste and a non-conductive paste, between an electrical wiring end of the multi-layer wiring substrate and an electrical wiring end of the flat substrate; and carrying out thermal compression with respect to the multi-layer wiring substrate and the flat substrate.

In this aspect of the present invention, it is possible to perform sealing and electrical connection together, and hence the number of steps can be reduced. Therefore, it is possible to manufacture a liquid ejection head of compact size having highly reliable connections and good airtightness, quickly and inexpensively, at a good production yield.

Preferably, the multi-layer wiring substrate is a ceramic multi-layer wiring substrate.

By using a ceramic having high strength, it is possible to increase the pressing force applied during the connection process, and therefore the reliability of the connections is improved, control of the manufacturing process is simplified, and improved production yield can be expected.

In order to attain the aforementioned object, the present invention is also directed to an image forming apparatus comprising any one of the liquid ejection heads described above.

In this aspect of the present invention, it is possible to make the image forming apparatus more compact, while improving reliability.

In the present invention, the common liquid chamber of a liquid ejection head is constituted by a ceramic multi-layer substrate, or the like, which has a recess structure, and the electrical wires are arranged in multiple layers inside this multi-layer substrate. Therefore, connection failures can be avoided, and reliability is improved.

Furthermore, by using a member having a recess structure for forming the common liquid chamber, it is possible to improve work efficiency when manufacturing the liquid ejection head, and the electrical wires can be arranged at high density while maintaining airtightness. Therefore, beneficial effects are obtained in that the liquid ejection head can be made more compact in size, and the overall size of the image forming apparatus can be reduced.

BRIEF DESCRIPTION OF THE DRAWINGS

The nature of this invention, as well as other objects and benefits thereof, will be explained in the following with reference to the accompanying drawings, in which like reference characters designate the same or similar parts throughout the figures and wherein.

DETAILED DESCRIPTION OF THE PREFERRED EMBODIMENTS

Figure 1:
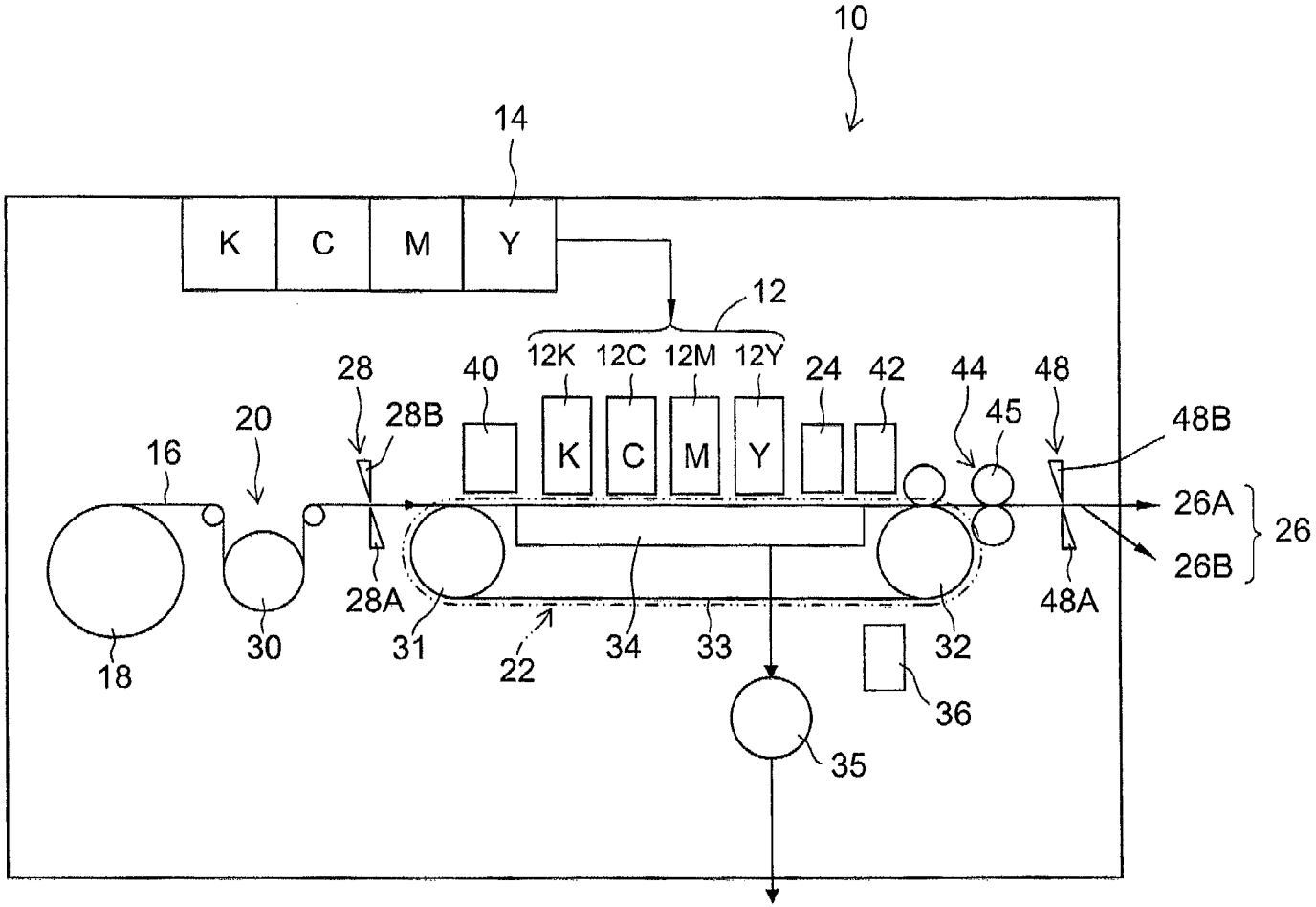
FIG. 1 is a general schematic drawing showing an approximate view of an inkjet recording apparatus serving as an image forming apparatus including a liquid ejection head (inkjet head) according to an embodiment of the present invention.

FIG. 1 is a general schematic drawing showing an approximate view of an image forming apparatus including an inlet head (liquid ejection head) according to an embodiment of the present invention.

As shown in FIG. 1, the inkjet recording apparatus 10 comprises: a printing unit 12 having a plurality of print heads 12K, 12C, 12M, and 12Y for ink colors of black (K), cyan (C), magenta (M), and yellow (Y), respectively; an ink storing and loading unit 14 for storing inks of K, C, M and Y to be supplied to the print heads 12K, 12C, 12M, and 12Y; a paper supply unit 18 for supplying recording paper 16; a decurling unit 20 for removing curl in the recording paper 16; a suction belt conveyance unit 22 disposed facing the nozzle face (ink-droplet ejection face) of the print unit 12, for conveying the recording paper 16 while keeping the recording paper 16 flat; a print determination unit 24 for reading a printed result produced by the printing unit 12; and a paper output unit 26 for outputting image-printed recording paper (printed matter) to the exterior.

In FIG. 1, a magazine for rolled paper (continuous paper) is shown as an embodiment of the paper supply unit 18; however, a plurality of magazines with papers of different paper width and quality may be jointly provided. Moreover, papers may be supplied in cassettes that contain cut papers loaded in layers and that are used jointly or in lieu of magazines for rolled papers.

In the case of a configuration in which rolled paper is used, a cutter 28 is provided as shown in FIG. 1, and the rolled paper is cut to a desired size by the cutter 28. The cutter 28 has a stationary blade 28A, whose length is not less than the width of the conveyance pathway of the recording paper 16, and a round blade 28B, which moves along the stationary blade 28A. The stationary blade 28A is disposed on the reverse side of the printed surface of the recording paper 16, and the round blade 28B is disposed on the printed surface side across the conveyance path. When cut paper is used, the cutter 28 is not required.

In the case of a configuration in which a plurality of types of recording paper can be used, it is preferable that an information recording medium such as a bar code and a wireless tag containing information about the type of paper be attached to the magazine, and by reading the information contained in the information recording medium with a predetermined reading device, the type of paper to be used is automatically determined, and ink-droplet ejection is controlled so that the ink-droplets are ejected in an appropriate manner in accordance with the type of paper.

The recording paper 16 delivered from the paper supply unit 18 retains curl due to having been loaded in the magazine. In order to remove the curl, heat is applied to the recording paper 16 in the decurling unit 20 by a heating drum 30 in the direction opposite from the curl direction in the magazine. The heating temperature at this time is preferably controlled so that the recording paper 16 has a curl in which the surface on which the print is to be made is slightly round outward.

The decurled and cut recording paper 16 is delivered to the belt conveyance unit 22. The belt conveyance unit 22 has a configuration in which an endless belt 33 is set around rollers 31 and 32 so that the portion of the endless belt 33 facing at least the nozzle face of the printing unit 12 and the sensor face of the print determination unit 24 forms a plane (flat plane).

There are no particular limitations on the structure of the belt conveyance unit 22, and it may use vacuum suction conveyance in which the recording paper 16 is conveyed by being suctioned onto the belt 33 by negative pressure created by suctioning air through suction holes provided on the belt surface, or it may be based on electrostatic attraction.

The belt 33 has a width that is greater than the width of the recording paper 16, and a plurality of suction restrictors (not shown) are formed on the belt surface. A suction chamber 34 is disposed in a position facing the sensor surface of the print determination unit 24 and the nozzle surface of the printing unit 12 on the interior side of the belt 33, which is set around the rollers 31 and 32, as shown in FIG. 1; and a negative pressure is generated by suctioning air from the suction chamber 34 by means of a fan 35, thereby the recording paper 16 on the belt 33 is held by suction.

The belt 33 is driven in the clockwise direction in FIG. 1 by the motive force of a motor (not shown in drawings) being transmitted to at least one of the rollers 31 and 32, which the belt 33 is set around, and the recording paper 16 held on the belt 33 is conveyed from left to right in FIG. 1.

Since ink adheres to the belt 33 when a marginless print job or the like is performed, a belt-cleaning unit 36 is disposed in a predetermined position (a suitable position outside the printing area) on the exterior side of the belt 33. Although the details of the configuration of the belt-cleaning unit 36 are not shown, embodiments thereof include a configuration in which the belt 33 is nipped with cleaning rollers such as a brush roller and a water absorbent roller, an air blow configuration in which clean air is blown onto the belt 33, or a combination of these. In the case of the configuration in which the belt 33 is nipped with the cleaning rollers, it is preferable to make the line velocity of the cleaning rollers different than that of the belt 33 to improve the cleaning effect.

The inkjet recording apparatus 10 can comprise a roller nip conveyance mechanism, in which the recording paper 16 is pinched and conveyed with nip rollers, instead of the belt conveyance unit 22. However, there is a drawback in the roller nip conveyance mechanism that the print tends to be smeared when the printing area is conveyed by the roller nip action because the nip roller makes contact with the printed surface of the paper immediately after printing. Therefore, the suction belt conveyance in which nothing comes into contact with the image surface in the printing area is preferable.

A heating fan 40 is disposed on the upstream side of the printing unit 12 in the conveyance pathway formed by the belt conveyance unit 22. The heating fan 40 blows heated air onto the recording paper 16 to heat the recording paper 16 immediately before printing so that the ink deposited on the recording paper 16 dries more easily.

Figure 2:
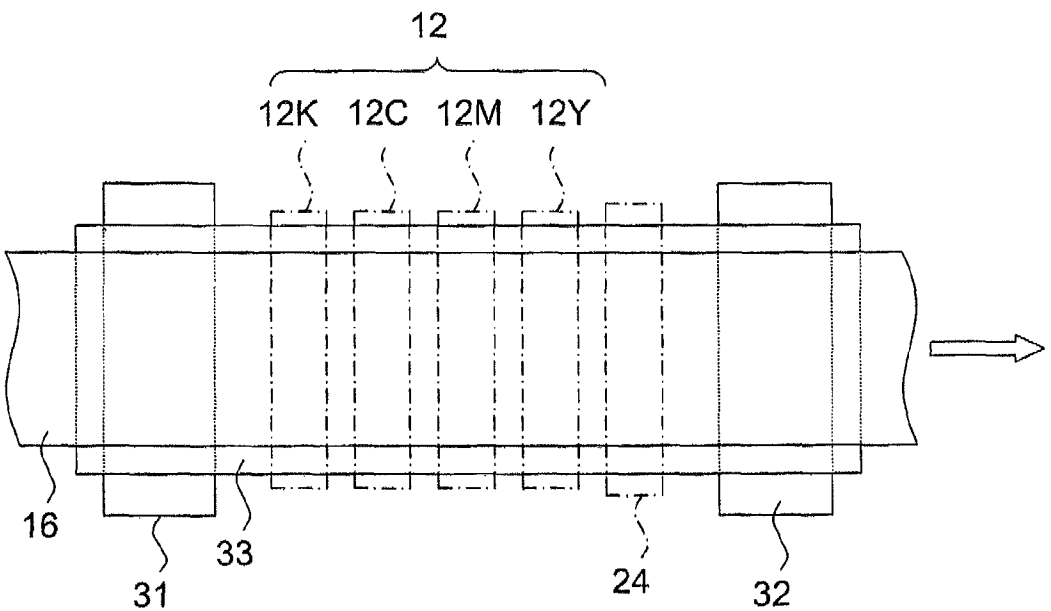
FIG. 2 is a principal plan diagram showing the periphery of a print unit of an inkjet recording apparatus serving as an image forming apparatus comprising a liquid ejection head (inkjet head) according to an embodiment of the present invention.

FIG. 2 is a principal plan diagram showing the periphery of the print unit 12 in the inkjet recording apparatus 10.

As shown in FIG. 2, the print unit 12 is a so-called "full line head" in which a line head having a length corresponding to the maximum paper width is arranged in a direction (main scanning direction) that is perpendicular to the paper conveyance direction (sub-scanning direction).

The print heads 12K, 12C, 12M and 12Y are constituted by line heads in which a plurality of ink ejection ports (nozzles) are arranged through a length exceeding at least one side of the maximum size recording paper 16 intended for use with the inkjet recording apparatus 10.

The print heads 12K, 12C, 12M, 12Y corresponding to respective ink colors are disposed in the order, black (K), cyan (C), magenta (M) and yellow (Y), from the upstream side (left-hand side in FIG. 1), following the direction of conveyance of the recording paper 16 (the paper conveyance direction). A color print can be formed on the recording paper 16 by ejecting the inks from the print heads 12K, 12C, 12M, and 12Y, respectively, onto the recording paper 16 while conveying the recording paper 16.

The print unit 12, which is constituted by full-line heads covering the entire width of the paper provided respectively for each of the ink colors, can record an image over the entire surface of the recording paper 16 by performing the action of moving the recording paper 16 and the print unit 12 relatively to each other in the paper conveyance direction (sub-scanning direction) just once (in other words, by means of a single sub-scan). Higher-speed printing is thereby made possible and productivity can be improved in comparison with a shuttle type head configuration in which a recording head moves reciprocally in a direction (main scanning direction) which is perpendicular to the paper conveyance direction (sub-scanning direction).

Here, the terms "main scanning direction" and "sub-scanning direction" are used in the following senses. More specifically, in a full-line head comprising rows of nozzles that have a length corresponding to the entire width of the recording paper, "main scanning" is defined as printing one line (a line formed of a row of dots, or a line formed of a plurality of rows of dots) in the breadthways direction of the recording paper (the direction perpendicular to the conveyance direction of the recording paper) by driving the nozzles in one of the following ways: (1) simultaneously driving all the nozzles; (2) sequentially driving the nozzles from one side toward the other; and (3) dividing the nozzles into blocks and sequentially driving the blocks of the nozzles from one side toward the other. The direction indicated by one line recorded by a main scanning action (the lengthwise direction of the band-shaped region thus recorded) is called the "main scanning direction".

On the other hand, "sub-scanning" is defined as to repeatedly perform printing of one line (a line formed of a row of dots, or a line formed of a plurality of rows of dots) formed by the main scanning action, while moving the full-line head and the recording paper relatively to each other. The direction in which sub-scanning is performed is called the sub-scanning direction. Consequently, the conveyance direction of the recording paper is the sub-scanning direction and the direction perpendicular to same is called the main scanning direction.

Although the configuration with the KCMY four standard colors is described in the present embodiment, combinations of the ink colors and the number of colors are not limited to those. Light inks or dark inks can be added as required. For example, a configuration is possible in which print heads for ejecting light-colored inks such as light cyan and light magenta are added.

As shown in FIG. 1, the ink storing and loading unit 14 has tanks for storing inks of the colors corresponding to the respective print heads 12K, 12C, 12M and 12Y, and the tanks are connected to respective print heads 12K, 12C, 12M, 12Y, via tube channels (not illustrated). Moreover, the ink storing and loading unit 14 also includes: a notifying device (display device, alarm generating device, or the like) for generating a notification if the remaining amount of ink has become low; a mechanism for preventing incorrect loading of ink of the wrong color.

The print determination unit 24 has an image sensor (line sensor) for capturing an image of the ink-droplet deposition result of the printing unit 12, and functions as a device to check for ejection defects such as clogs of the nozzles in the printing unit 12 from the ink-droplet deposition results evaluated by the image sensor.

The print determination unit 24 of the present embodiment is configured with at least a line sensor having rows of photoelectric transducing elements with a width that is greater than the ink-droplet ejection width (image recording width) of the print heads 12K, 12C, 12M, and 12Y. This line sensor has a color separation line CCD sensor including a red (R) sensor row composed of photoelectric transducing elements (pixels) arranged in a line provided with an R filter, a green (G) sensor row with a G filter, and a blue (B) sensor row with a B filter. Instead of a line sensor, it is possible to use an area sensor composed of photoelectric transducing elements which are arranged two-dimensionally.

The print determination unit 24 reads a test pattern image printed by the print heads 12K, 12C, 12M, and 12Y for the respective colors, and determines the ejection of each head. The ejection determination includes the presence of the ejection, measurement of the dot size, and measurement of the dot deposition position.

A post-drying unit 42 is disposed following the print determination unit 24. The post-drying unit 42 is a device to dry the printed image surface, and includes a heating fan, for example. It is preferable to avoid contact with the printed surface until the printed ink dries, and a device that blows heated air onto the printed surface is preferable.

In cases in which printing is performed with dye-based ink on porous paper, blocking the pores of the paper by the application of pressure prevents the ink from coming into contact with ozone and other substances that cause dye molecules to break down, and has the effect of increasing the durability of the print.

A heating/pressurizing unit 44 is disposed following the post-drying unit 42. The heating/pressurizing unit 44 is a device to control the glossiness of the image surface, and the image surface is pressed with a pressure roller 45 having a predetermined uneven surface shape while the image surface is heated, and the uneven shape is transferred to the image surface.

The printed matter generated in this manner is outputted from the paper output unit 26. The target print (i.e., the result of printing the target image) and the test print are preferably outputted separately. In the inkjet recording apparatus 10, a sorting device (not shown) is provided for switching the outputting pathways in order to sort a printed matter with the target print and a printed matter with the test print, and to send them to paper output units 26A and 26B, respectively. When the target print and the test print are simultaneously formed in parallel on the same large sheet of paper, the test print portion is cut and separated by a cutter (second cutter) 48. The cutter 48 is disposed directly in front of the paper output unit 26, and is used for cutting the test print portion from the target print portion when a test print has been performed in the blank portion of the target print. The structure of the cutter 48 is the same as the first cutter 28 described above, and has a stationary blade 48A and a round blade 48B.

Although not shown in drawings, the paper output unit 26A for the target prints is provided with a sorter for collecting prints according to print orders.

The print heads 12K, 12C, 12M and 12Y provided for the inks have a common structure, and therefore below, the heads are discussed with reference to a representative print head labeled with the reference numeral 50.

Figure 3:
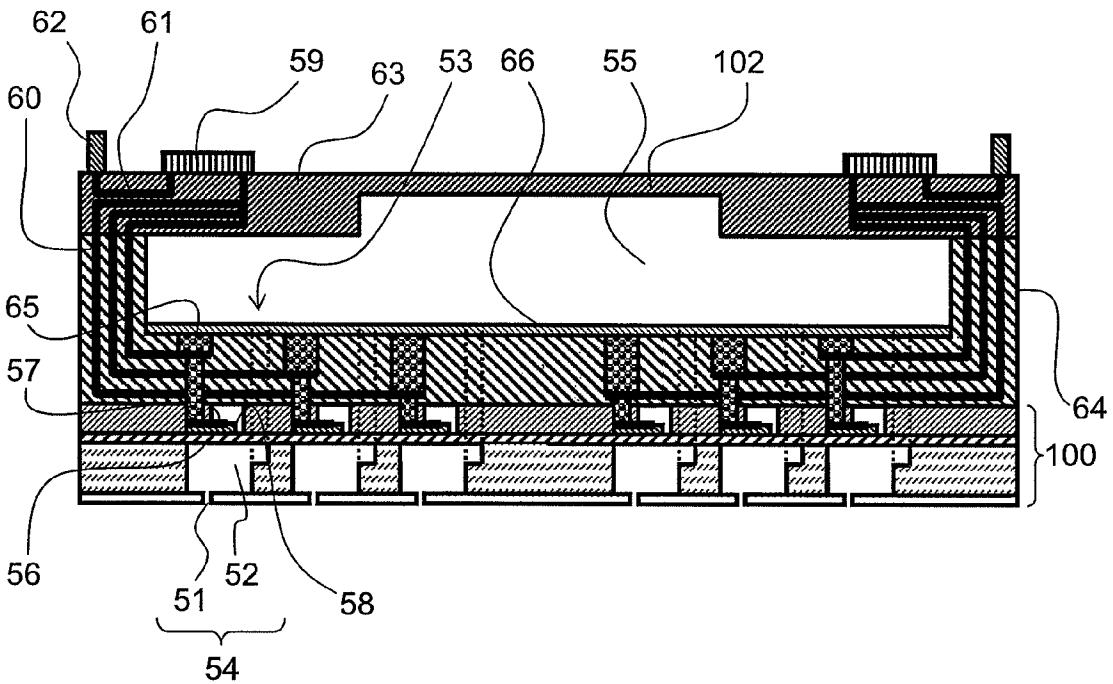
FIG. 3 is a cross-sectional diagram of a liquid ejection head according to a first embodiment of the present invention.

FIG. 3 is a diagram showing the composition of an inkjet head (liquid ejection head) according to a first embodiment of the present invention.

The walls of a common liquid chamber 55 in the liquid ejection head are formed by a ceramic multi-layer wiring substrate 64 having a recessed shape, and an upper substrate 63 having a substantially planar shape. The upper substrate 63 has a thin section 102 in order to prevent cross-talk between the pressure chamber units. By using a ceramic multi-layer wiring substrate 64 having a recessed shape of this kind, it is possible to reduce the number of connection steps for the electrical wires, and furthermore, it is possible to reduce the number of components. Therefore, reliability can be improved and costs can be reduced, in comparison with the related art. More specifically, the side walls and the bottom surface of the common liquid chamber 55 in the liquid ejection head are constituted by the ceramic multi-layer wiring substrate 64. The ceramic multi-layer wiring substrate 64 has a recessed shape including projecting sections and a plane section. The projecting sections of the ceramic multi-layer wiring substrate 64 constitutes the side walls of the common liquid chamber 55, and the plane section of the ceramic multi-layer wiring substrate 64 constitutes the bottom surface of the common liquid chamber 55. The ceiling of the common liquid chamber 55 is constituted by the upper substrate 63 having a substantially planar shape. The pressure inside the common liquid chamber 55 changes when ink is ejected from the liquid ejection head (from one nozzle), and such pressure change in the common liquid chamber 55 may affect liquid ejection of the other nozzles. In order to alleviate the effects of this pressure variation on the other nozzles (e.g., cross-talk between the pressure chamber units), the upper substrate 63 has the thin section 102. The ceramic multi-layer wiring substrate 64 has a recessed shape of this kind, and thereby it is possible to reduce the number of connection steps for the electrical wires and the number of components, in comparison with the related art. Therefore, reliability can be improved and costs can be reduced.

A pressure chamber unit 54 includes a pressure chamber 52 and a nozzle 51 for ejecting ink, and each pressure chamber unit 54 is connected to the common liquid chamber 55 via an ink supply port 53. One surface (in FIG. 3, the ceiling) of the pressure chamber 52 is constituted by a diaphragm 56. Piezoelectric elements 58 are bonded on top of the diaphragm 56, and each of the piezoelectric elements 58 applies a pressure to the diaphragm 58 and thereby deforms the diaphragm 58. An individual electrode 57 is formed on the upper surface of each piezoelectric element 58. The diaphragm 56 also serves as a common electrode.

Each piezoelectric element 58 is interposed between the common electrode (diaphragm 56) and the corresponding individual electrode 57, and each piezoelectric element 58 deforms when a drive voltage is applied between the common electrode (diaphragm 56) and the corresponding individual electrode 57. The diaphragm 56 is pressed by the deformation of each piezoelectric element 58, and accordingly the volume of each pressure chamber 52 is reduced and ink is ejected from each nozzle 51. When the voltage applied between the common electrode (diaphragm 56) and an individual electrode 57 is released, the corresponding piezoelectric element 58 returns to its original position, the volume of the corresponding pressure chamber 52 returns to its original size, and new ink is supplied into the pressure chamber 52 from the common liquid chamber 55 via the corresponding ink supply port 53.

Drive circuits (electrical circuit) 59 each of which includes an IC (integral circuit), are located on the upper surface of the upper substrate 63. The electrical wires 60 and 61 are connected to the drive circuits 59, and input signals and output signals are transmitted via these electrical wires. The drive circuits 59 are connected electrically to the main body of the image forming apparatus by means of connectors 62 provided on the upper substrate 63, whereby electrical signals are transmitted. Input signals transmitted from the connectors 62 are input to the drive circuits 59 via the electrical wires 61. Thereupon, electrical signals for driving the piezoelectric elements 58 are output and then transmitted to the individual electrodes 57 via the electrical wires 60. The electrical wires 60 are arranged in multi-layered fashion inside the upper substrate 63 and the ceramic multi-layer wiring substrate 64, which has a recess-shaped structure, thereby achieving high-density electrical wires.

The electrical wires 60 are respectively connected to the individual electrodes 57 by means of through electrodes 65. Insulation is provided in such a manner that each through electrode does not make contact with other through electrodes. In order to prevent the through electrodes 65 from making direct contact with the ink, an insulating film 66 is formed on the bottom face of the recess section of the ceramic multi-layer wiring substrate 64, which has a recess-shaped structure.

It is required for this insulating film 66 to have a thickness greater than the undulations that are caused by the through electrodes 65 made of a conductive paste.

In the present embodiment, the ceramic multi-layer wiring substrate 64, which has a recess-shaped structure, is made of a ceramic material. Hence, the ceramic multi-layer wiring substrate 64 needs to be calcined during manufacture, and the calcination process results in no small deformation of the shape. However, the ceramic multi-layer wiring substrate 64 is merely a member which defines the common liquid chamber 55 (constitutes the side walls and the bottom surface of the common liquid chamber 55), and high accuracy is not required. Some degree of variation is tolerable. A portion of the electrical wires of the ceramic multi-layer wiring substrate 64 having a recess-shaped structure may be exposed externally. Preferably, the wires are formed entirely inside the ceramic multi-layer wiring substrate, and thereby problems of shorting, or the like, can be avoided and reliability is improved.

For the material constituting the ceramic multi-layer wiring substrate 64, which has a recess-shaped structure, a ceramic material having high thermal conductivity, such as alumina ($Al_2O_3$), may be used. In such a case, even if heat is generated, this heat can escape into the ink inside the common liquid chamber 55, and therefore the heat radiating effects are improved.

Moreover, it is also possible to use LTCC (Low Temperature Co-fired Ceramic) for the material constituting the ceramic multi-layer wiring substrate 64, which has a recess-shaped structure. In this case, since the LTCC has poor resistance to liquids, it is necessary to form a protective film on the interior parts which make contact with ink. As the material used for this protective film, a dense material, such as silicon nitride, is desirable.

The structure of the liquid ejection head according to the present embodiment is described in further detail below, on the basis of the component members.

Figure 4A:
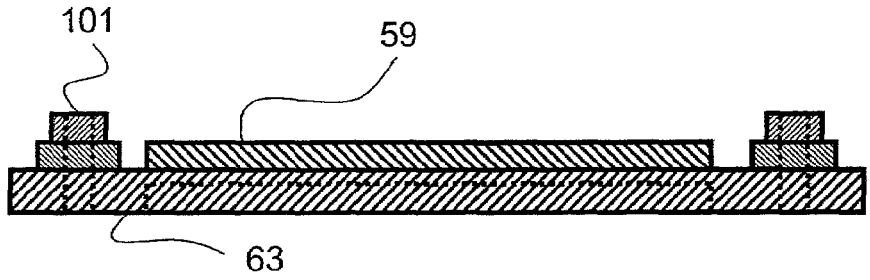
FIG. 4A illustrates a side view of a member forming the liquid ejection head according to the first embodiment of the present invention.
Figure 4B:
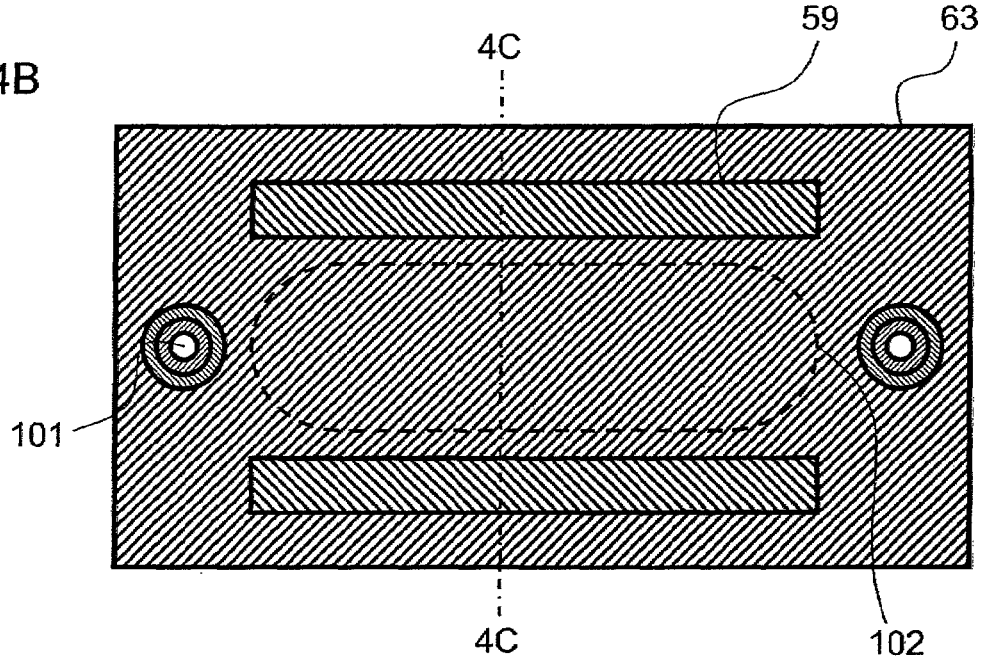
FIG. 4B illustrates a plan view of the member forming the liquid ejection head according to the first embodiment of the present invention.
Figure 4C:
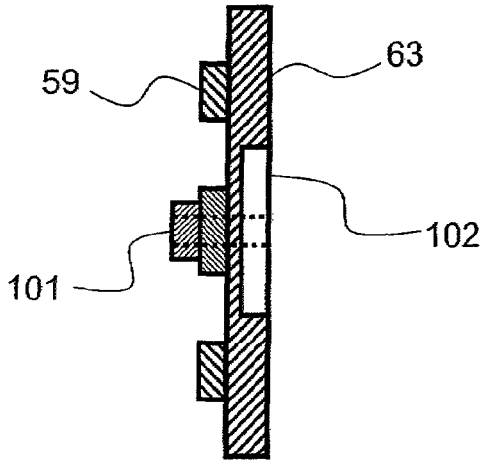
FIG. 4C illustrates a cross-sectional view of the member forming the liquid ejection head according to the first embodiment of the present invention.

FIGS. 4A to 4C are diagrams showing the upper substrate 63. The upper substrate 63 is a member constituting the common liquid chamber 55 of the liquid ejection head. FIG. 4A is a side view diagram of the upper substrate 63, FIG. 4B is a top view diagram of the upper substrate 63, and FIG. 4C is a cross-sectional diagram along line 4C-4C in FIG. 4B.

The drive circuits 59 each of which includes an IC are mounted and bonded on the upper substrate 63, and the connectors 62 for connecting to the main body of the printer are installed on the upper substrate 63. Ink is supplied to the common liquid chamber 55 via ink supply ports 101 provided with the common liquid chamber. The pressure inside the common liquid chamber 55 changes when ink is ejected from the liquid ejection head (from one nozzle), and accordingly liquid ejection of the other nozzles is affected. In order to alleviate the effects (cross-talk) of this pressure variation on the other nozzles, the thin section 102 having a damper function is formed in the upper substrate 63.

Next, the structure of the ceramic multi-layer wiring substrate 64 which has a recess shape and forms the common liquid chamber 55 of the liquid ejection head, is described with reference to FIGS. 5 and 6.

Figure 5:
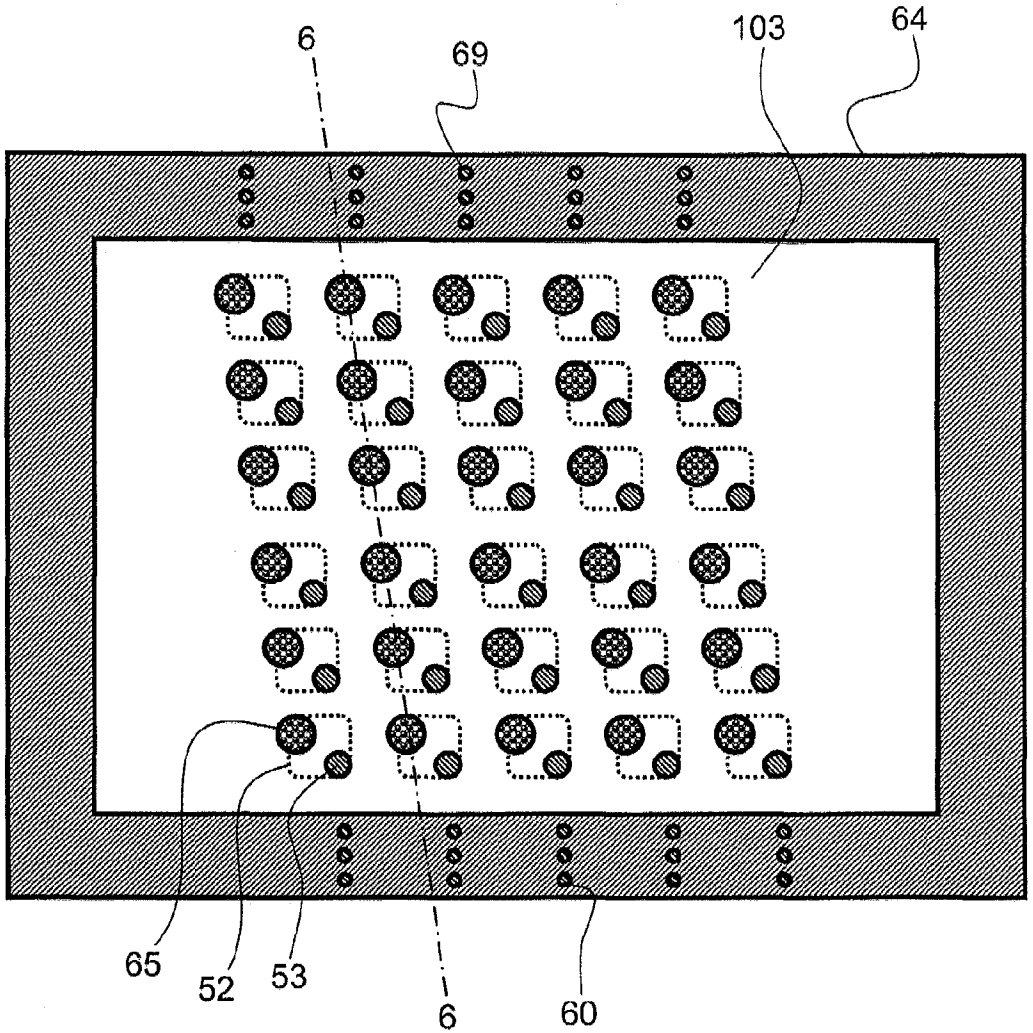
FIG. 5 is a plan view of members including a recess-shaped multi-layer wiring substrate forming the liquid ejection head according to the first embodiment of the present invention.
Figure 6:
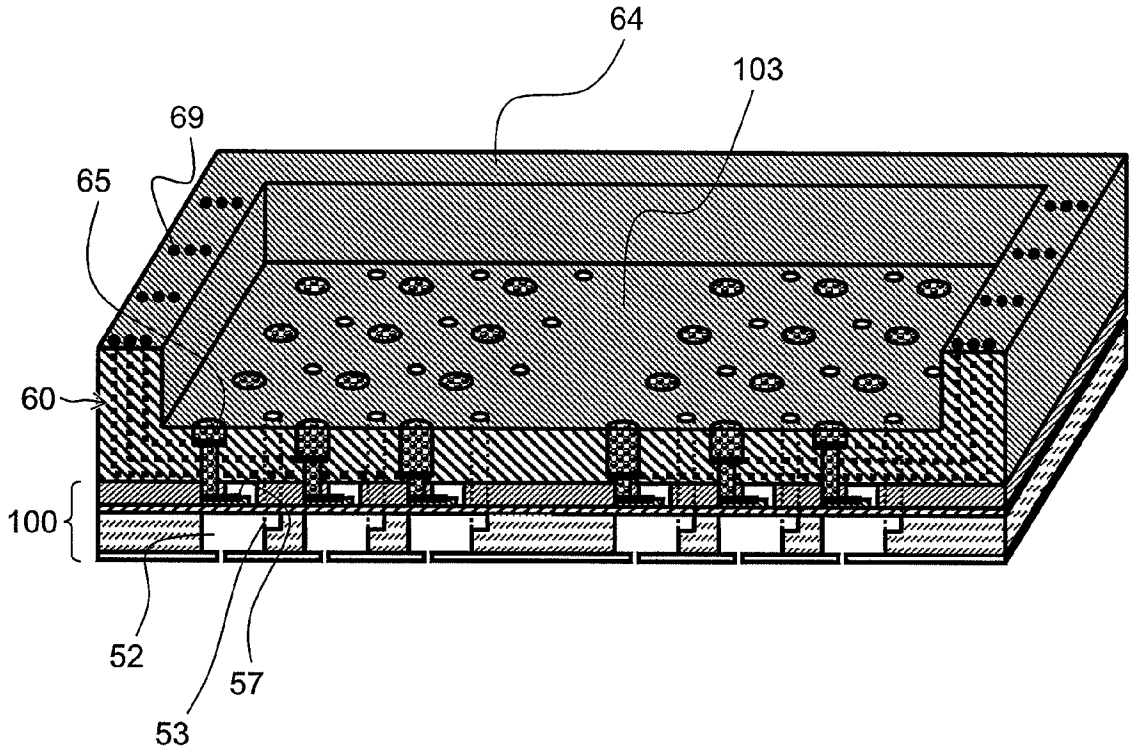
FIG. 6 is a perspective view of the members including the recess-shaped multi-layer wiring substrate forming the liquid ejection head according to the first embodiment of the present invention.

FIG. 5 is a top plan diagram showing the ceramic multi-layer wiring substrate 64 having a recess-shaped structure which forms the common liquid chamber 55 of the liquid ejection head. FIG. 6 is a perspective diagram showing a section along line 6-6 in FIG. 5.

The pressure chambers 52 are located below the bottom surface 103 of the ceramic multi-layer wiring substrate 64, which has a recess-shaped structure forming the common liquid chamber 55. The pressure chambers 52 are connected to the common liquid chamber 55 via the ink supply ports 53. The electrical wires 60 inside the ceramic multi-layer wiring substrate 64, which has a recess-shaped structure, are connected to the individual electrodes 57 by means of the through electrodes 65. The electrical wires 60 serve as connection electrodes 69 at the upper surface of the ceramic multi-layer wiring substrate 64 having a recess-shaped structure (upper surface of the projecting sections of the ceramic multi-layer wiring substrate 64). Hence, the connection electrodes 69 are formed by the electrical wires 60 for connecting with other substrates, or the like.

The liquid ejection head according to the present embodiment is manufactured by arranging these in a matrix configuration.

Figure 7:
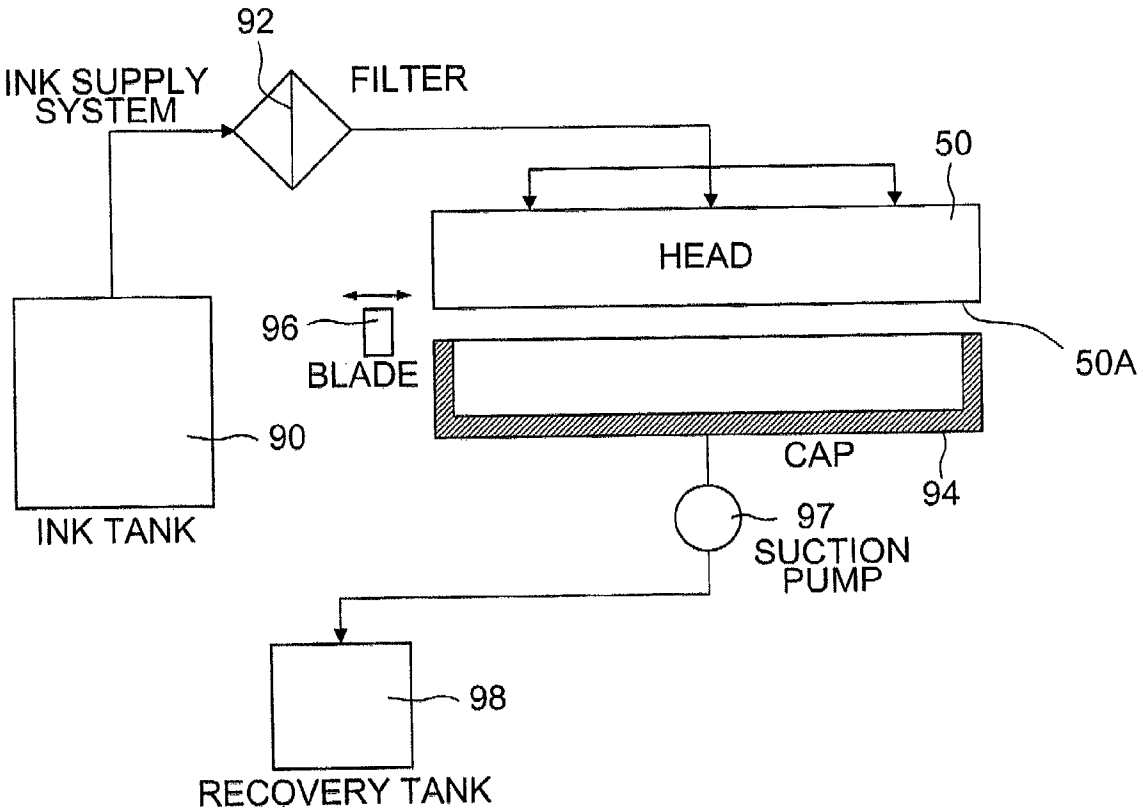
FIG. 7 is a general schematic drawing showing an approximate view of an ink supply system in an inkjet recording apparatus serving as an image forming apparatus including a liquid ejection head (inkjet head) according to an embodiment of the present invention.

FIG. 7 is a schematic drawing showing the configuration of the ink supply system in the inkjet recording apparatus 10. The ink tank 90 is a base tank for supplying ink to the print head 50 and is set in the ink storing and loading unit 14 described with reference to FIG. 1. The examples of the ink tank 90 include a refillable type and a cartridge type: when the remaining amount of ink is low, the ink tank 90 of the refillable type is filled with ink through a filling port (not shown) and the ink tank 90 of the cartridge type is replaced with a new one. In order to change the ink type in accordance with the intended application, the cartridge type is suitable, and it is preferable to represent the ink type information with a bar code or the like on the cartridge, and to perform ejection control in accordance with the ink type. The ink tank 90 in FIG. 7 is equivalent to the ink storing and loading unit 14 described above with reference to FIG. 1.

A filter 92 for removing foreign matters and bubbles is disposed in the middle of the line which connects the ink tank 90 to the print head 50 as shown in FIG. 7. The filter mesh size is preferably equivalent to or less than the diameter of the nozzle of the print head 50 and commonly about 20 μm.

Although not shown in FIG. 7, it is preferable to provide a sub-tank integrally to the print head 50 or nearby the print head 50. The sub-tank has a damper function for preventing variation in the internal pressure of the head and a function for improving refilling of the print head.

The inkjet recording apparatus 10 is also provided with a cap 94 as a device to prevent the nozzles from drying out or to prevent an increase in the ink viscosity in the vicinity of the nozzles, and a cleaning blade 96 as a device to clean the nozzle face 50A.

A maintenance unit including the cap 94 and the cleaning blade 96 can be relatively moved with respect to the print head 50 by a movement mechanism (not shown), and is moved from a predetermined holding position to a maintenance position below the print head 50 as required.

The cap 94 is displaced upward and downward in a relative fashion with respect to the print head 50 by an elevator mechanism (not shown). When the power of the inkjet recording apparatus 10 is switched off or when the apparatus is in a standby state for printing, the elevator mechanism raises the cap 94 to a predetermined elevated position so as to make tight contact with the print head 50, and the nozzle region of the nozzle surface 50A is thereby covered by the cap 94.

The cleaning blade 96 is composed of rubber or another elastic member, and can slide on the ink ejection surface (nozzle surface 50A) of the print head 50 by means of a blade movement mechanism (not shown). If there are ink droplets or foreign matter adhering to the nozzle surface 50A, then the nozzle surface 50A is wiped by causing the cleaning blade 96 to slide over the nozzle surface 50A, thereby cleaning same.

During printing or standby, when the frequency of use of specific nozzles 51 is reduced and ink viscosity increases in the vicinity of the nozzles 51, a preliminary discharge is made to eject the ink degraded due to the increase in viscosity toward the cap 94.

Also, when bubbles have become intermixed in the ink inside the print head 50 (the ink inside the pressure chamber 52), the cap 94 is placed on the print head 50, the ink inside the pressure chamber 52 (the ink in which bubbles have become intermixed) is removed by suction with a suction pump 97, and the suction-removed ink is sent to a collection tank 98. This suction action entails the suctioning and removal of degraded ink whose viscosity has increased and hardened also when ink is initially loaded into the head or when service has started after a long period of being stopped.

In other words, when a state in which ink is not ejected from the print head 50 continues for a certain amount of time or longer, the ink solvent in the vicinity of the nozzles 51 evaporates and ink viscosity increases. In such a state, ink can no longer be ejected from the nozzle 51 even if the actuator (piezoelectric element 58) for the ejection driving is operated. Before reaching such a state (in a viscosity range that allows ejection by the operation of the piezoelectric element 58) the piezoelectric element 58 is operated to perform the preliminary discharge to eject the ink whose viscosity has increased in the vicinity of the nozzle toward the ink receptor. After the nozzle surface 50A is cleaned by a wiper such as the cleaning blade 96 provided as the cleaning device for the nozzle face 50A, a preliminary discharge is also carried out in order to prevent the foreign matter from becoming mixed inside the nozzles 51 by the wiper sliding operation. The preliminary discharge is also referred to as "dummy discharge", "purge", "liquid discharge", and so on.

When bubbles have become intermixed in the nozzle 51 or the pressure chamber 52, or when the ink viscosity inside the nozzle 51 has increased over a certain level, ink can no longer be ejected by the preliminary discharge, and a suctioning action is carried out as follows.

More specifically, when bubbles have become intermixed in the ink inside the nozzle 51 and the pressure chamber 52, ink can no longer be ejected from the nozzle 51 even if the piezoelectric element 58 is operated. Also, when the ink viscosity inside the nozzle 51 has increased over a certain level, ink can no longer be ejected from the nozzle 51 even if the actuator 58 is operated. In these cases, the ink in which bubbles have become intermixed or the ink whose viscosity has increased inside the pressure chamber 52 is removed by suction with the suction pump 97 by placing the cap 94 on the nozzle face 50A of the print head 50.

However, this suction action is performed with respect to all of the ink in the pressure chambers 52, and therefore the amount of ink consumption is considerable. Hence, it is desirable that a preliminary ejection is carried out, whenever possible, while the increase in viscosity is still minor. The cap 94 illustrated in FIG. 7 functions as a suctioning device and it may also function as an ink receptacle for preliminary ejection.

Moreover, desirably, the inside of the cap 94 is divided by means of partitions into a plurality of areas corresponding to the nozzle rows, thereby achieving a composition in which suction can be performed selectively in each of the demarcated areas, by means of a selector, or the like.

Figure 8:
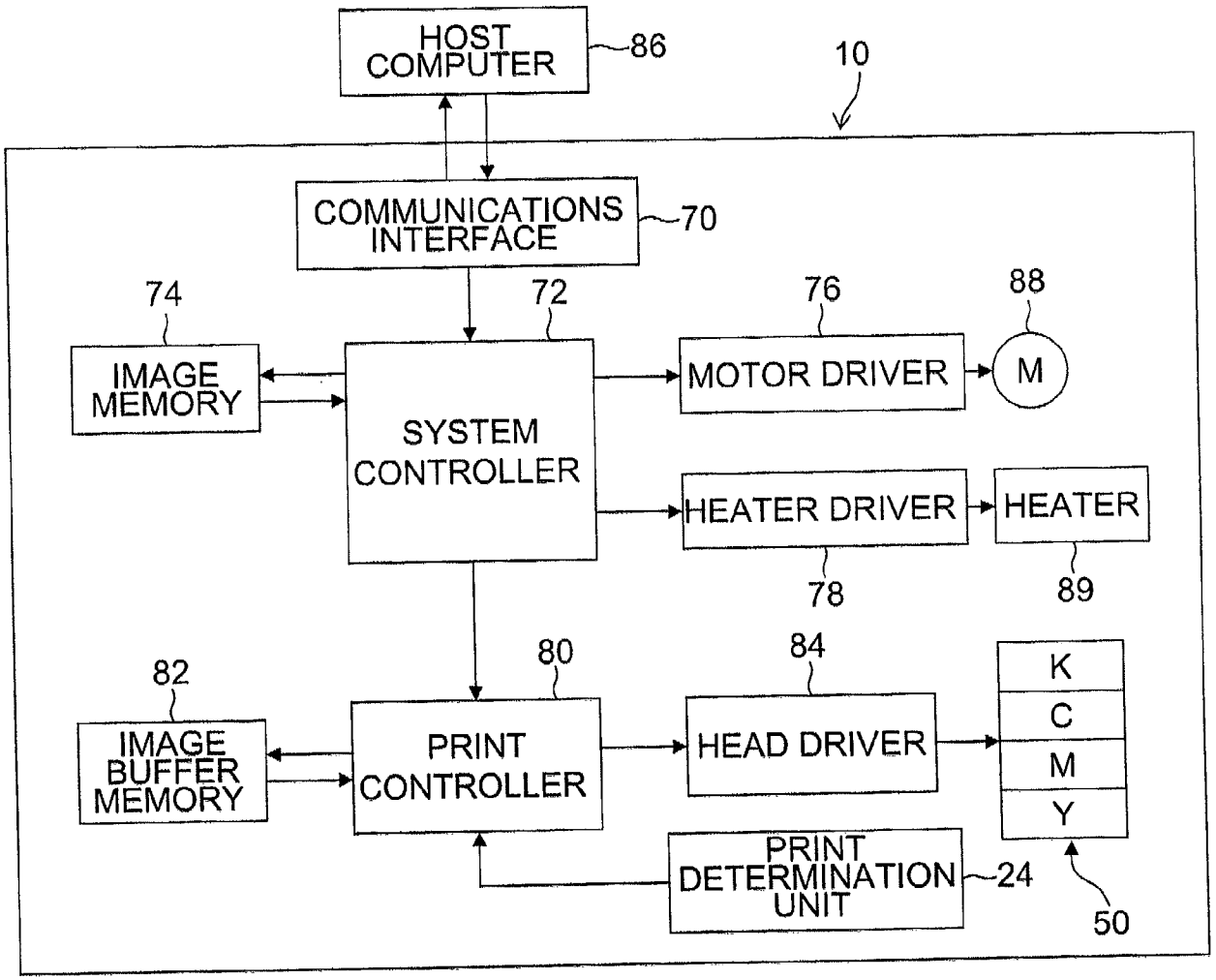
FIG. 8 is a block diagram showing the system composition of an inkjet recording apparatus serving as an image forming apparatus including a liquid ejection head (inkjet head) according to an embodiment of the present invention.

FIG. 8 is a principal block diagram showing the system configuration of the inkjet recording apparatus 10. The inkjet recording apparatus 10 includes a communication interface 70, a system controller 72, an image memory 74, a motor driver 76, a heater driver 78, a print controller 80, an image buffer memory 82, a head driver 84, and the like.

The communication interface 70 is an interface unit for receiving image data sent from a host computer 86. A serial interface such as USB, IEEE1394, Ethernet, wireless network, or a parallel interface such as a Centronics interface may be used as the communication interface 70. A buffer memory (not shown) may be mounted in this portion in order to increase the communication speed. The image data sent from the host computer 86 is received by the inlet recording apparatus 10 through the communication interface 70, and is temporarily stored in the image memory 74. The image memory 74 is a storage device for temporarily storing images inputted through the communication interface 70, and data is written and read to and from the image memory 74 through the system controller 72. The image memory 74 is not limited to a memory composed of semiconductor elements, and a hard disk drive or another magnetic medium may be used.

The system controller 72 is a control unit for controlling the various sections, such as the communications interface 70, the image memory 74, the motor driver 76, the heater driver 78, and the like. The system controller 72 is constituted by a central processing unit (CPU) and peripheral circuits thereof, and the like, and in addition to controlling communications with the host computer 86 and controlling reading and writing from and to the image memory 74, or the like, it also generates a control signal for controlling the motor 88 of the conveyance system and the heater 89.

The motor driver (drive circuit) 76 drives the motor 88 in accordance with commands from the system controller 72. The heater driver 78 drives the heater 89 of the post-drying unit 42 or the like in accordance with commands from the system controller 72.

The print controller 80 has a signal processing function for performing various tasks, compensations, and other types of processing for generating print control signals from the image data stored in the image memory 74 in accordance with commands from the system controller 72 so as to supply the generated print control signal (print data) to the head driver 84. Prescribed signal processing is carried out in the print controller 80, and the ejection amount and the ejection timing of the ink droplets from the respective print heads 50 are controlled via the head driver 84, on the basis of the print data. Thereby, prescribed dot size and dot positions can be achieved.

The print controller 80 is provided with the image buffer memory 82; and image data, parameters, and other data are temporarily stored in the image buffer memory 82 when image data is processed in the print controller 80. The aspect shown in FIG. 8 is one in which the image buffer memory 82 accompanies the print controller 80; however, the image memory 74 may also serve as the image buffer memory 82. Also possible is an aspect in which the print controller 80 and the system controller 72 are integrated to form a single processor.

The head driver 84 drives the actuators 58 of the print head 50 on the basis of print data supplied by the print controller 80. The head driver 84 can be provided with a feedback control system for maintaining constant drive conditions for the print heads.

The print determination unit 24 is a block that includes the line sensor (not shown) as described above with reference to FIG. 1. The print determination unit 24 reads the image printed on the recording paper 16, determines the print conditions (presence of the ejection, variation in the dot formation, and the like) by performing desired signal processing, or the like, and provides the determination results of the print conditions to the print controller 80.

According to requirements, the print controller 80 makes various corrections with respect to the head 50 on the basis of information obtained from the print determination unit 24.

Next, a method of manufacturing a liquid ejection head according to a first embodiment of the present invention is described below.

Figure 9A:
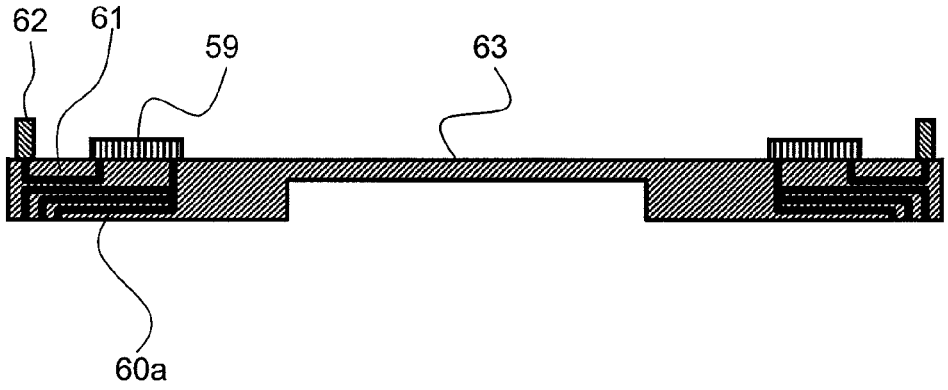
FIGS. 9A to 9C are cross-sectional diagrams of members forming the liquid ejection head according to the first embodiment of the present invention.
Figure 9B:
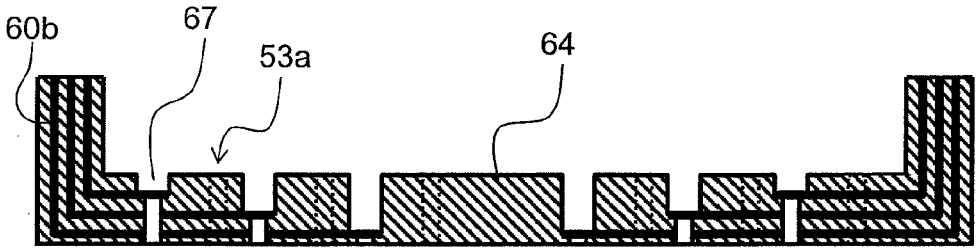
Figure 9C:
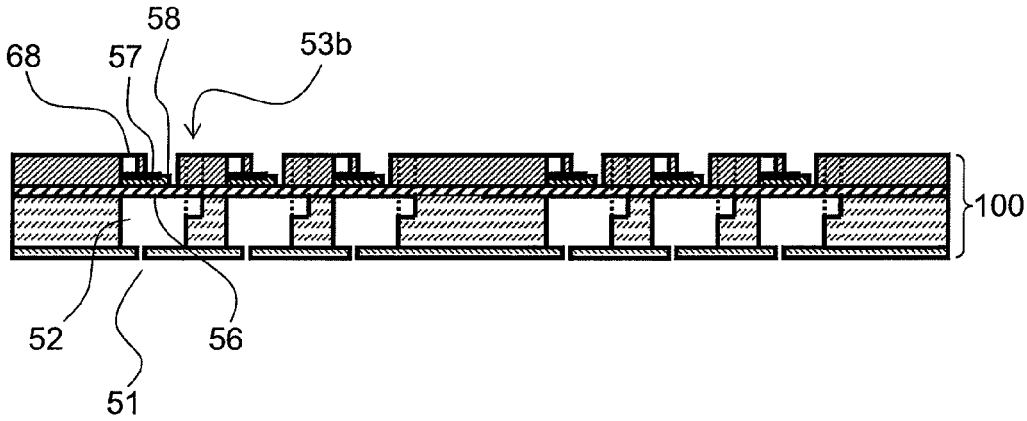

FIGS. 9A to 9C are cross-sectional diagrams of the members constituting the liquid ejection head according to the present embodiment.

The liquid ejection head according to the present embodiment includes the following three members: the upper substrate 63 shown in FIG. 9A; the ceramic multi-layer wiring substrate 64, which has a recess-shaped structure, shown in FIG. 9B; and a liquid ejection substrate 100 provided with the piezoelectric elements 58 as shown in FIG. 9C.

The drive circuits 59 including ICs and the connectors 62 for connecting to the main body of the image forming apparatus are provided on the upper surface of the upper substrate 63 shown in FIG. 9A. Electrical wires 61 for connecting the connectors 62 to the drive circuits 59, and electrical wires 60*a* for transmitting the output signals from the drive circuits 59, are formed inside the upper substrate 63.

As shown in FIG. 9B, the electrical wires 60*b* for transmitting electrical signals have a multiple-layer structure, and the electrical wires 60*b* are provided inside the ceramic multi-layer wiring substrate 64, which has a recess-shaped structure. Through holes (via holes) 67 for forming the through electrodes, and ink supply port forming holes 53*a*, are also provided in the ceramic multi-layer wiring substrate 64.

In the liquid ejection substrate 100 shown in FIG. 9C, nozzles 51, pressure chambers 52, piezoelectric elements 58, individual electrodes 57, a diaphragm 56 forming a common electrode, connection holes 68 for forming through electrodes, and ink supply port forming holes 53*b* are formed. From a viewpoint of workability (depending on the circumstances of manufacturing process), the nozzles 51 and the pressure chambers 52 may, partially, not yet be formed in the liquid ejection substrate 100, and the nozzles 51 and the pressure chambers 52 may be completed in a subsequent processing step.

Figure 10A:
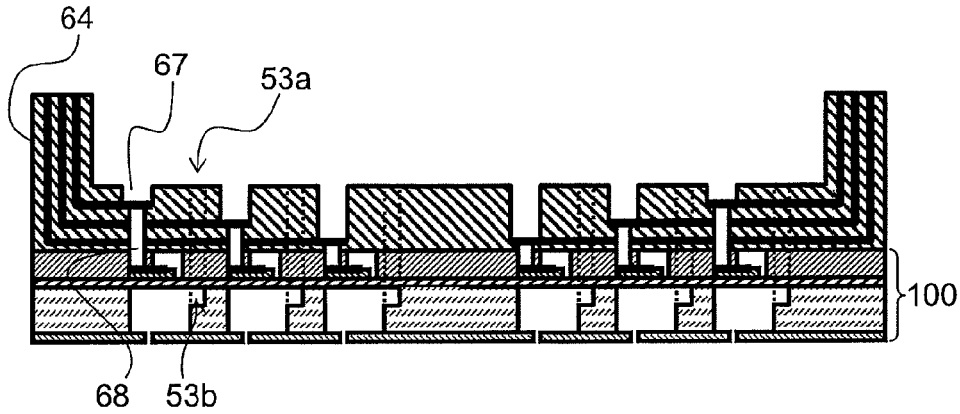
FIGS. 10A to 10C are diagrams showing a method of manufacturing the liquid ejection head according to the first embodiment of the present invention.
Figure 10B:
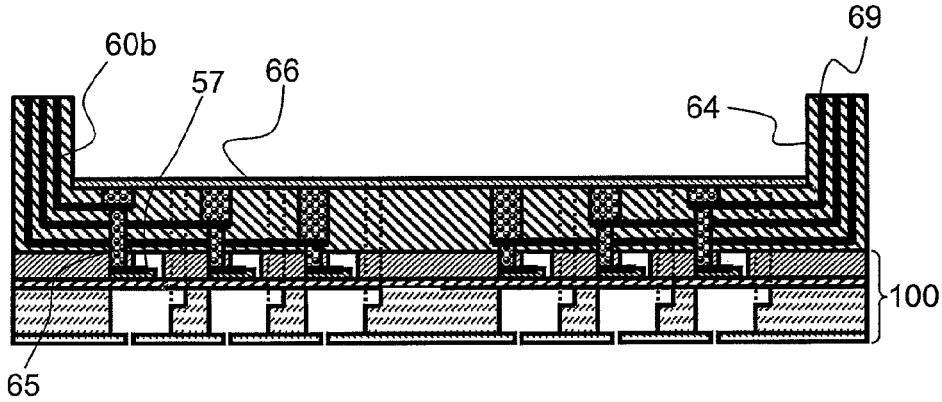
Figure 10C:
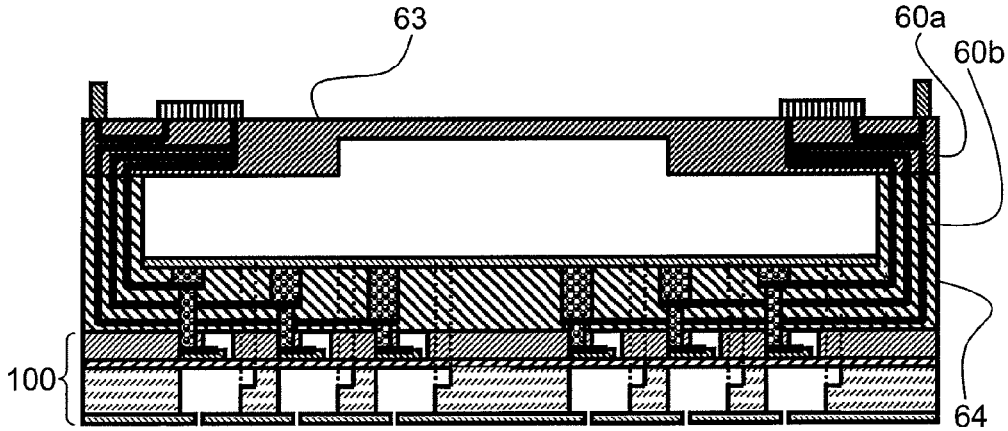

Next, the method of manufacturing the liquid ejection head according to the present embodiment is described specifically with reference to FIGS. 10A to 10C.

Firstly, the ceramic multi-layer wiring substrate 64 (shown in FIG. 9B), which has a recess-shaped structure, and the liquid ejection substrate 100 (shown in FIG. 9C) are bonded together mechanically. More specifically, an adhesive including epoxy resin, or the like, is applied to the surfaces that are to be connected, and the surfaces are then bonded together by applying pressure. The structure manufactured by this step is shown in FIG. 10A.

In this case, before bonding, the positions of the through holes (via holes) 67 provided in the ceramic multi-layer wiring substrate 64 having a recess-shaped structure and the positions of the connection holes 68 provided in the liquid ejection substrate 100 are aligned in order to form the through electrodes. Similarly, the positions of the ink supply port forming holes 53*a* provided in the ceramic multi-layer wiring substrate 64 having a recess-shaped structure and the positions of the ink supply port forming holes 53*b* provided in the liquid ejection substrate 100 are also aligned. After this position alignment, the ceramic multi-layer wiring substrate 64 and the liquid ejection substrate 100 are bonded together, as described above.

Thereupon, a conductive paste is filled into the electrical connection sections (67, 68) including: the through holes (via holes) 67 provided in the ceramic multi-layer wiring substrate 64 having a recess-shaped structure; and the connection holes 68 provided in the liquid ejection substrate 100. Since wirings in the ceramic multi-layer wiring substrate 64, which has a recess-shaped structure, are arranged in a multi-layered configuration, then the electrical connection sections (67, 68) each including the a through hole (via hole) 67 and a connection hole 68, do not have a uniform internal volume. Hence, the amount of conductive paste required varies, and it is necessary to adjust the amount of conductive paste introduced, according to requirements. A dispenser, or the like, is used for filling of the conductive paste into the holes.

In this case, in order to ensure more reliable electrical connections, the following steps are effective. Firstly, the structure obtained by bonding the ceramic multi-layer wiring substrate 64 having a recess-shaped structure with the liquid ejection substrate 100 and then filling the conductive paste into the electrical connection sections, is introduced into a vacuum chamber. Thereupon, the pressure is reduced temporarily by evacuating the air from the interior of the chamber, and the interior of the chamber is then returned to the atmospheric pressure. Then, the laminated structure of the ceramic multi-layer wiring substrate 64 having a recess-shaped structure and the liquid ejection substrate 100 is got out of the vacuum chamber. Through these steps, intermixed air in the electrical connection sections can be expelled, and the through electrodes 65 having reliable connections with the electrical wires 60*b* and the individual electrodes 57 are formed.

Moreover, in order to ensure reliable electrical connections, the following steps may be adopted. Firstly, the structure obtained by bonding the ceramic multi-layer wiring substrate 64 having a recess-shaped structure with the liquid ejection substrate 100, is introduced into a vacuum chamber. The pressure is then reduced temporarily by evacuating the air from the interior of the chamber. Under this reduced pressure condition, conductive paste is filled into the electrical connection sections. Thereupon, the interior of the chamber is returned to atmospheric pressure, and the bonded structure of the ceramic multi-layer wiring substrate 64 having a recess-shaped structure and the liquid ejection units is got out of the chamber. Consequently, since the conductive paste is filled in after expelling air from the through holes, the through electrodes 65 having reliable connections with the electrical wires 60*b* and the individual electrodes 57 are formed.

Figure 11A:
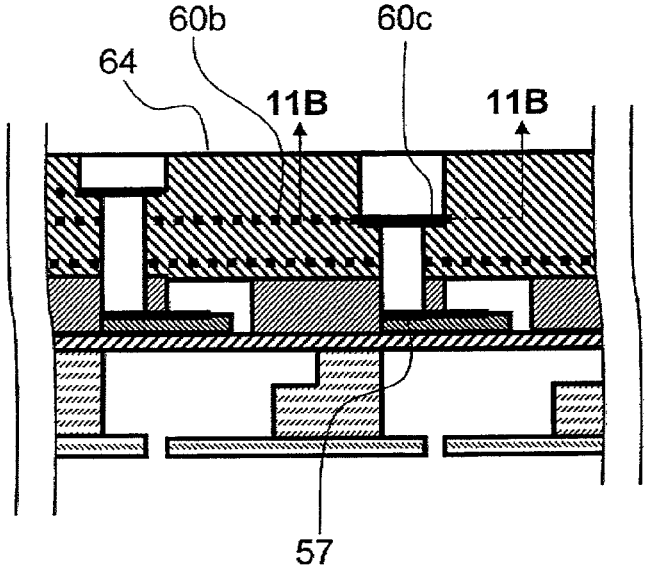
FIG. 11A is a cross-sectional diagram of electrode sections of the recess-shaped multi-layer wiring substrate forming the liquid ejection head according to the first embodiment of the present invention.
Figure 11B:
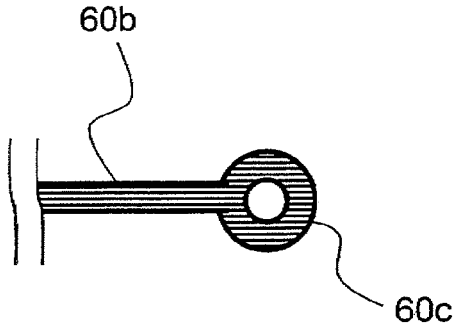
FIG. 11B is a plan diagram of the electrode sections of the recess-shaped multi-layer wiring substrate forming the liquid ejection head according to the first embodiment of the present invention.

FIGS. 11A and 11B are diagrams showing the state of electrodes inside the ceramic multi-layer wiring substrate 64 having a recess-shaped structure.

FIG. 11A is a cross-sectional diagram of the liquid ejection head according to the present embodiment before forming the through electrodes 65. FIG. 11B is a diagram showing the state of an electrode in a cross-section cut perpendicularly to the plane of FIG. 11A, along line 11B-11B. A land section 60*c* is provided at the tip of an electrical wire 60*b* inside the ceramic multi-layer wiring substrate 64 having a recess-shaped structure. The land section 60*c* and the corresponding individual electrode 57 are electrically connected by means of a through electrode 65. The through holes 67 are formed by removing the upper region of the ceramic multi-layer wiring substrate 64, in such a manner that the land sections 60*c* are exposed. Thereby, the upper portion of each through hole 67 is manufactured to have a countersunk hole figure, and the contact surface between the land section 60*c* and the conductive paste can be increased. Consequently, reliable connections can be achieved.

As shown in FIG. 10B, after forming the through electrodes 65 in this way, an insulating film 66 is formed on the bottom surface of the recess section of the ceramic multi-layer wiring substrate 64. This insulating film 66 is formed to have a thickness greater than the undulations of the through electrodes 65 (roughness generated during filling the conductive paste into the through holes 67 and the connection holes 68).

Thereupon, the structure obtained through the steps shown in FIGS. 10A and 10B is bonded mechanically and connected electrically with the upper substrate 63 shown in FIG. 9A.

More specifically, firstly, the connection electrodes 69 which are formed by the exposed portions of the electrical wires 60*b* at the upper surfaces of the walls constituting the ceramic multi-layer wiring substrate 64 having a recess-shaped structure, are polished and leveled. Moreover, the exposed portions of the electrical wires 60*a* in the upper substrate 63, are also polished and leveled. Thereupon, an anisotropic conductive film (ACF) is interposed between the upper substrate 63 and the ceramic multi-layer wiring substrate 64, and then the thermal compression bonding is carried out. In this case, a mechanical bond and an electrical connection can be achieved simultaneously.

In cases where thermal compression bonding is carried out using an anisotropic conductive paste (ACP) or a non-conductive paste (NCP), rather than an anisotropic film (ACF), it is also possible to achieve a mechanical bond and an electrical connection simultaneously, similarly to the case of an anisotropic film (ACF).

Through these processing steps described above, the electrical wires 60*b* of the ceramic multi-layer wiring substrate 64 having a recess-shaped structure are connected reliably with the electrical wires 60*a* of the upper substrate 63, and a liquid ejection head is completed as shown in FIG. 10C.

Next, a second embodiment of the present invention is described below.

Below, a liquid ejection head according to the second embodiment is described with reference to FIG. 12.

A ceramic multi-layer wiring substrate 164 is bonded with a lower substrate 163. The ceramic multi-layer wiring substrate 164 has a recess-shaped structure including projecting sections and a plane section, and the lower substrate 163 has a substantially planar shape. A common liquid chamber 155 of the liquid ejection head according to the present embodiment is formed by bonding the ceramic multi-layer wiring substrate 164 and the lower substrate 163, in such a manner that the recess portion of the ceramic multi-layer wiring substrate 164 is covered with the lower substrate 163. In other words, the side walls and ceiling of the common liquid chamber 155 are constituted by the ceramic multi-layer wiring substrate 164. The side walls of the common liquid chamber 155 are constituted by the projecting sections of the recess-shaped structure of the ceramic multi-layer wiring substrate 164, and the ceiling of the common liquid chamber 155 is constituted by the plane section of the recess-shaped structure of the ceramic multi-layer wiring substrate 164.

A pressure chamber unit 154 includes a nozzle 151 for ejecting ink and a pressure chamber 152. Each pressure chamber unit 154 is connected, by means of an ink supply port 153, to the common liquid chamber 155, which supplies the pressure chamber units 154 with ink. One surface (in FIG. 12, the ceiling) of each pressure chamber 152 is constituted by a diaphragm 156, and piezoelectric elements 158 are bonded on top of the diaphragm 156. Each piezoelectric element 158 applies a pressure to the diaphragm 156, thereby causing the diaphragm 156 to deform. An individual electrode 157 is formed on the upper surface of each piezoelectric element 158. The diaphragm 156 also serves as a common electrode.

Each piezoelectric element 158 is interposed between the common electrode (diaphragm 156) and the corresponding individual electrode 157, and it deforms when a drive voltage is applied between the common electrode (diaphragm 156) and the individual electrode 157. The diaphragm 156 is pressed by the deformation of each piezoelectric element 158, in such a manner that the volume of the corresponding pressure chamber 152 is reduced and ink is ejected from the corresponding nozzle 151. When the voltage applied between the common electrode (diaphragm 156) and the individual electrode 157 is released, the piezoelectric element 158 returns to its original position, and the volume of the pressure chamber 152 returns to its original size. Accordingly, new ink is supplied into the pressure chamber 152 from the common liquid chamber 155 via the ink supply port 153.

Drive circuits (electrical circuits) 159 including ICs are provided on the upper surface of the ceramic multi-layer wiring substrate 164 having a recess-shaped structure. The electrical wires 160 are connected to the drive circuits 159, and input signals and output signals are transmitted via the electrical wires 160. Electrical signals are transmitted to each drive circuit 159 by means of a connector (not shown) which provides an electrical connection to the main body of the image forming apparatus. Electrical signals for driving the piezoelectric elements 158 are output from the drive circuits 159 and transmitted via the electrical wires 160. The electrical wires 160 are arranged in a multi-layered configuration inside the ceramic multi-layer wiring substrate 164 having a recess-shaped structure, thereby achieving high-density electrical wiring.

The electrical wires 160 are respectively connected to the individual electrodes 157 by means of electrical wires 170 and through electrodes 165. Insulation is provided in such a manner that each through electrode does not make contact with the adjacent through electrodes. In order to prevent the through electrodes 165 from making direct contact with the ink, an insulating film 166 is formed on the surface of the lower substrate 163.

This insulating film 166 is formed to have a thickness greater than the undulations (roughness generated during filling conductive paste) of the through electrodes 165.

Figure 12:
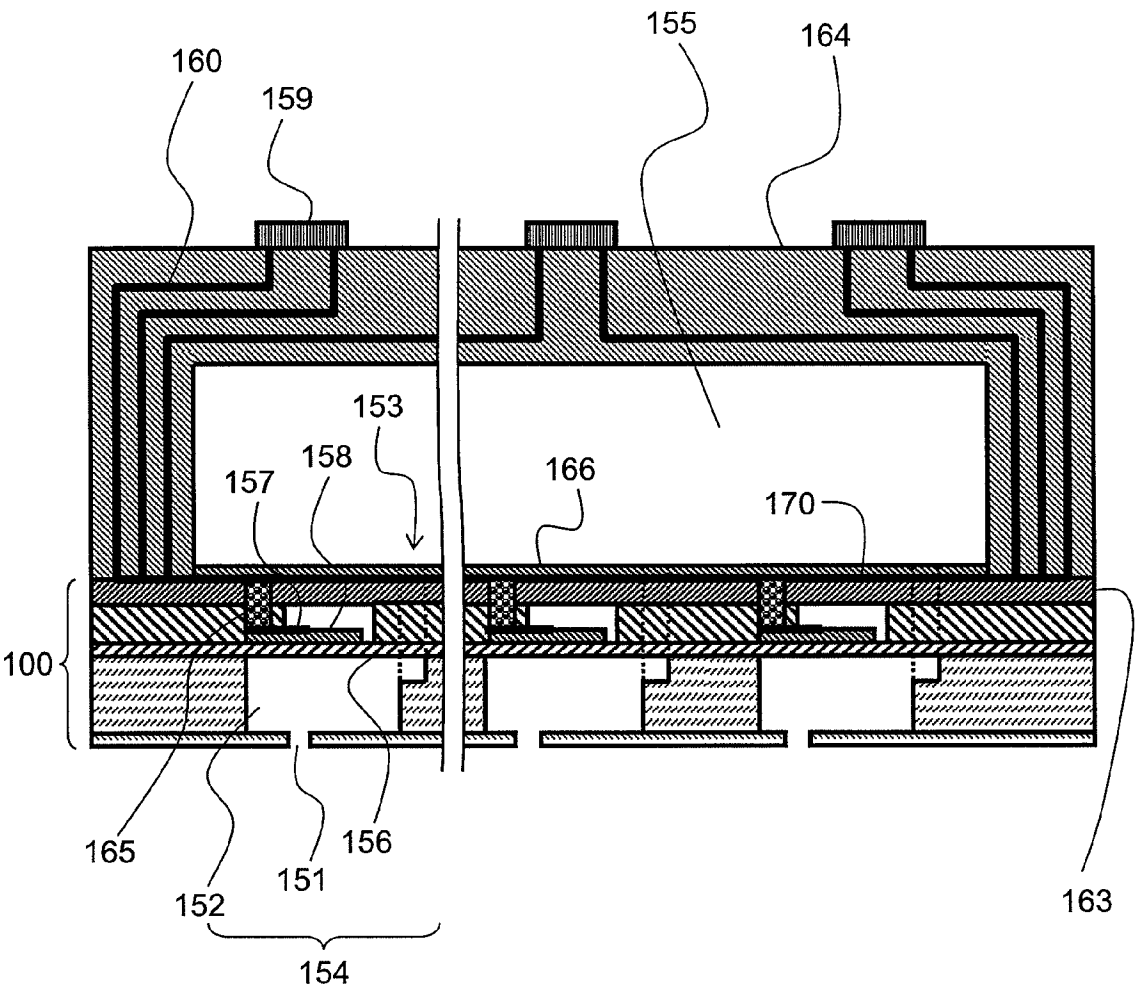
FIG. 12 is a cross-sectional diagram of a liquid ejection head according to a second embodiment of the present invention.

Although not shown in FIG. 12, a common liquid chamber ink supply port for supplying ink to the common liquid chamber 155 is provided in the ceramic multi-layer wiring substrate 164 having a recess-shaped structure. Moreover, by covering internal walls (the internal walls that are arranged on the forward side and the rearward side with respect to the plane of the drawing) of the common liquid chamber 155 with a resin film in parallel with the plane of the drawing, it is also possible to obtain a damper function in order to prevent cross-talk between the pressure chamber units.

Next, a method of manufacturing the liquid ejection head according to the present embodiment is described specifically with reference to FIGS. 13A to 13D.

Figure 13A:
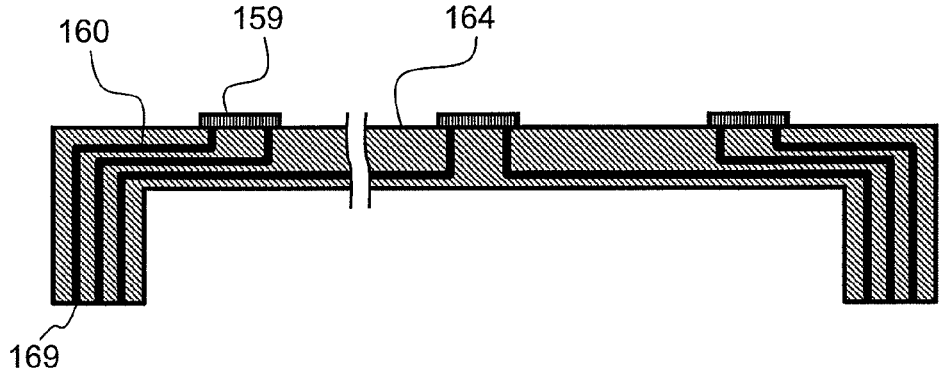
FIGS. 13A to 13D are diagrams showing a method of manufacturing the liquid ejection head according to the second embodiment of the present invention.
Figure 13B:
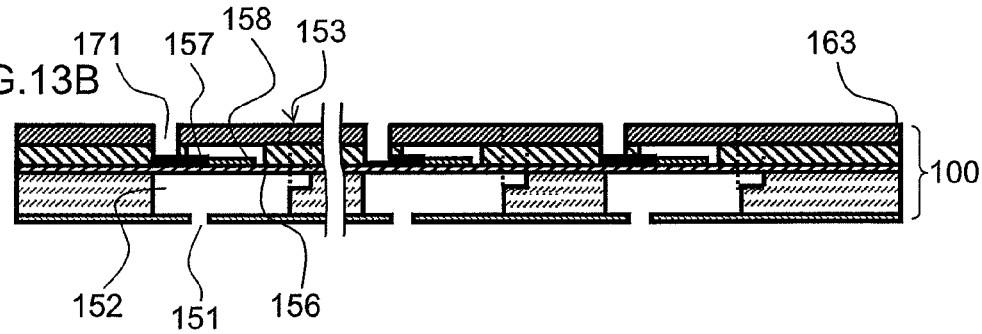

The liquid ejection head according to the present embodiment includes the ceramic multi-layer wiring substrate 164 having a recess-shaped structure shown in FIG. 13A and the lower substrate 163 having a substantially planar shape shown in FIG. 13B.

Electrical wires 160 are formed in a multi-layered fashion inside the ceramic multi-layer wiring substrate 164 having a recess-shaped structure. Drive circuits 159 including ICs are disposed on top of the ceramic multi-layer wiring substrate 164 having a recess-shaped structure, and the drive circuits 159 are connected to the electrical wires 160.

The lower substrate 163 having a substantially planar shape is formed previously with nozzles 151, pressure chambers 152, ink supply ports 153, a diaphragm 156 which also serves as a common electrode, individual electrodes 157, piezoelectric elements 158, and connection holes 171 for connecting to the individual electrodes 157.

Firstly, a conductive paste is filled into the connection holes 171 in the lower substrate 163, and a heat treatment or the like is then carried out, thereby obtaining the through electrodes 165. Thereupon, the electrical wires 170 are formed so as to cover the through electrodes 165. The structure obtained through these steps is shown in FIG. 13C.

In the first embodiment described above, the upper region of the ceramic multi-layer wiring substrate 64 needs to be removed so that the land sections 60*c* are exposed, in order to obtain the through holes 67 in the shape of a countersunk hole figure. However, in the present embodiment, this removing step (i.e., counter sinking process) is not required, and consequently the connection holes 171 can be manufactured easily at low cost. In addition, in the present embodiment, the volume inside the connection holes 171 is virtually uniform, and the amount of conductive paste required is also uniform. Moreover, the surface on which the connection holes 171 are formed is flat. Therefore, it is possible to fill the conductive paste into the connection holes 171 by a known screen printing method.

Figure 13C:
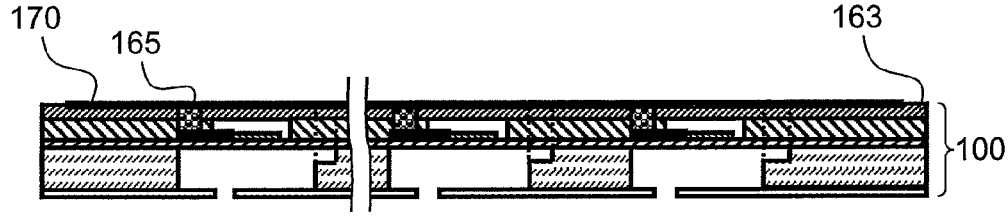

Subsequently, the ceramic multi-layer wiring substrate 164 (shown in FIG. 13A) and the substrate obtained by further forming an insulating film 166 onto the lower substrate 163 shown in FIG. 13C, are bonded together mechanically and connected electrically.

More specifically, firstly, the connection electrodes 169 formed by the exposed portions of the electrical wires 160 at the edges (the upper surfaces of the projecting sections) of the ceramic multi-layer wiring substrate 164 having a recess-shaped structure, are polished and leveled. An anisotropic conductive film (ACF) is then inserted at the bonding sections between the ceramic multi-layer wiring substrate 164 and the lower substrate 163, and thermal compression bonding is carried out, thereby creating a mechanical bond and an electrical connection, simultaneously. Since the mechanical bond and the electrical connection are made together in one operation, then it is possible readily to achieve sealing and electrical connection in a highly reliable fashion.

Similarly to the case of an anisotropic conductive film (ACF), an anisotropic conductive paste (ACP) or a non-conductive paste (NCP) may be applied, rather than an anisotropic film (ACF), between the members. By carrying out thermal compression bonding after applying one of these pastes, it is possible to achieve a mechanical bond and an electrical connection, simultaneously.

Figure 13D:
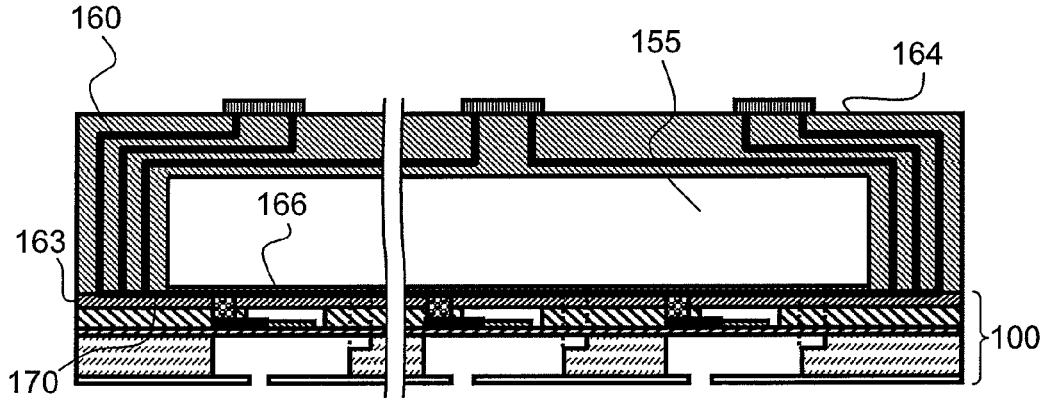

Through the processing steps described above, the electrical wires 160 of the ceramic multi-layer wiring substrate 164 having a recess-shaped structure are connected reliably to the electrical wires 170 of the lower substrate 163. Consequently, a liquid ejection head having the common liquid chamber 155 is completed as shown in FIG. 13D.

Liquid ejection heads according to embodiments of the present invention are described above in which a ceramic multi-layer wiring substrate having a recess-shaped structure is used as an embodiment of a constituent member; however, similar actions and beneficial effects can be obtained, even if the wiring substrate is made of a material other than ceramic, such as glass epoxy, polyimide, or the like, provided that it is a multi-layer wiring substrate having a recess-shaped structure.

Furthermore, liquid ejection heads according to embodiments of the present invention and image forming apparatuses including these liquid ejection heads have been described in detail, but the present invention is not limited to the aforementioned embodiments. It is of course possible for improvements or modifications of various kinds to be implemented, within a range which does not deviate from the essence of the present invention.

It should be understood that there is no intention to limit the invention to the specific forms disclosed, but on the contrary, the invention is to cover all modifications, alternate constructions and equivalents falling within the spirit and scope of the invention as expressed in the appended claims.

What is claimed is:

1. A method of manufacturing a liquid ejection head, comprising a multi-layer wiring substrate which has a recess-shaped structure and is provided with first electrical wires and first holes, and a liquid ejection substrate which includes piezoelectric elements and is provided with second electrical wires and second holes, the recess-shaped structure including a base section to form one of a ceiling and a floor of a common liquid chamber in the liquid ejection head and a projecting section to form a side wall of the common liquid chamber, the first electrical wires being formed at least partially inside the multi-layer wiring substrate, the first electrical wires being arranged inside the projection section along the side wall of the common liquid chamber, the method including the steps of:

mechanically bonding the multi-layer wiring substrate to the liquid ejection substrate so that the first holes of the multi-layer wiring substrate are superimposed onto the second holes of the liquid ejection substrate so as to form electrical connections holes constituted by the first holes and the second holes; and filling a conductive paste into the electrical connection holes so that the first electrical wires and the second electrical wires are electrically connected via the conductive paste, wherein;

the electrical connection holes do not have a uniform volume; and the first electrical wires provided with the multi-layer wiring substrate and the second electrical wires provided with the liquid ejection substrate are electrically connected through the steps of:

filling the conductive paste into the electrical connection holes formed by mechanically bonding the multi-layer wiring substrate to the liquid ejection substrate;

putting the multi-layer wiring substrate and the liquid ejection substrate which are mechanically bonded, into a vacuum chamber;

reducing pressure inside the vacuum chamber; and returning the pressure inside the vacuum chamber to atmospheric pressure, after reducing pressure inside the vacuum chamber.

2. The method of manufacturing the liquid ejection head as defined in claim 1, wherein the multi-layer wiring substrate is a ceramic multi-layer wiring substrate.

* * * * *